US008042970B2

(12) United States Patent
Wang et al.

(10) Patent No.: US 8,042,970 B2
(45) Date of Patent: Oct. 25, 2011

(54) LED ILLUMINATOR

(75) Inventors: Jyh-Lih Wang, Jhongli (TW); Hui-Hsin Kao, Jhongli (TW); Jerry Lin, Jhongli (TW)

(73) Assignee: Trend Lighting Corp., Jhongli, Taoyuan Hsien (TW)

( * ) Notice: Subject to any disclaimer, the term of this patent is extended or adjusted under 35 U.S.C. 154(b) by 231 days.

(21) Appl. No.: 12/469,728

(22) Filed: May 21, 2009

(65) Prior Publication Data

US 2009/0296386 A1 Dec. 3, 2009

(30) Foreign Application Priority Data

May 28, 2008 (TW) ..... 97209250 U

(51) Int. Cl.
*F21S 4/00* (2006.01)

(52) U.S. Cl. ..... 362/249.02; 362/97.3

(58) Field of Classification Search ..... 362/294, 362/373, 612, 249.02, 97.3
See application file for complete search history.

(56) References Cited

U.S. PATENT DOCUMENTS

| | | | | |
|---|---|---|---|---|
| 7,654,691 | B2 * | 2/2010 | Liu et al. | 362/249.02 |
| 7,806,577 | B2 * | 10/2010 | Van As et al. | 362/555 |
| 2004/0062040 | A1 * | 4/2004 | Blume et al. | 362/231 |
| 2005/0276069 | A1 * | 12/2005 | Taniguchi et al. | 362/600 |
| 2006/0012286 | A1 * | 1/2006 | Cull et al. | 313/500 |
| 2006/0232964 | A1 * | 10/2006 | Hoshi et al. | 362/231 |
| 2007/0115656 | A1 * | 5/2007 | Chou et al. | 362/228 |
| 2007/0253219 | A1 * | 11/2007 | Kim et al. | 362/612 |
| 2008/0192507 | A1 * | 8/2008 | Chang | 362/633 |

* cited by examiner

*Primary Examiner* — Julie Shallenberger
(74) *Attorney, Agent, or Firm* — patenttm.us

(57) ABSTRACT

An LED illuminator has a seat and multiple LED modules mounted on the seat. The seat has multiple chambers, each of which has two opposite sidewalls, a bottom, two through holes and an opening. The two through holes are respectively defined on the sidewalls and the opening is defined the bottom. The LED modules are respectively mounted on the sidewalls of the chambers on the seat and standing on the seat at an inclined angle to allow lights pass through the openings of the chambers. Therefore, each chamber has two light sources from two opposite sidewalls and the lights of the two lights source pass through the opening of the chamber. The LED illuminator provides a wide illuminating angle.

7 Claims, 7 Drawing Sheets

LED ILLUMINATOR

BACKGROUND OF THE INVENTION

1. Field of the Invention

The present invention relates to an illuminator, and more particularly to an LED illuminator.

2. Description of Related Art

Since the natural resources are drying, some new substitute energy resources are proposed but cannot immediately fulfill all requirements for human. Therefore, to save natural resources becomes a very important issue. Accordingly, many electronic devices or equipment are improved to decrease power consumption. For example, if a conventional tungsten lamp consumes 100 units of electronic power, only 5 units of electronic power is transformed into light and the rest of the electronic power is transformed into the heat. Thus, the transforming efficiency of the conventional tungsten lamp is bad. Additionally, the heat sink or coolers are also required to dissipate the heat generated from the conventional tungsten lamp. Some of the heat sink or cooler are driven by electric power. Since the conventional tungsten lamp has the low transforming efficiency, a substitute lighting source "LED" is more and more popular for the illuminator.

As mentioned above, LEDs have low power consumption, long usage term, etc. However, the LEDs also have disadvantages, such as a narrow illuminating angle and a fixed lighting direction while a light source of the illuminator should have wide illuminating angle and uniform illuminance.

Therefore, in order to use the LED as the light source of the illuminator, removing the disadvantage of the LED for the illuminator is important.

SUMMARY OF THE INVENTION

The main objective of the present invention is to provide an LED illuminator having a wide illuminating angle.

The LED illuminator in accordance with the present invention has a seat and multiple LED modules mounted on the seat. The seat has multiple chambers, each of which has two opposite sidewalls, a bottom, two through holes and an opening. The two through holes are respectively defined on the sidewalls and the opening is defined the bottom. The LED modules are respectively mounted on the sidewalls of the chambers on the seat and standing on the seat at an inclined angle to allow lights pass through the openings of the chambers. Therefore, each chamber has two light sources from two opposite sidewalls and the lights of the two lights source pass through the opening of the chamber. The LED illuminator provides a wide illuminating angle.

Other objectives, advantages and novel features of the invention will become more apparent from the following detailed description when taken in conjunction with the accompanying drawings.

DETAILED DESCRIPTION OF THE INVENTION

Figure 1:
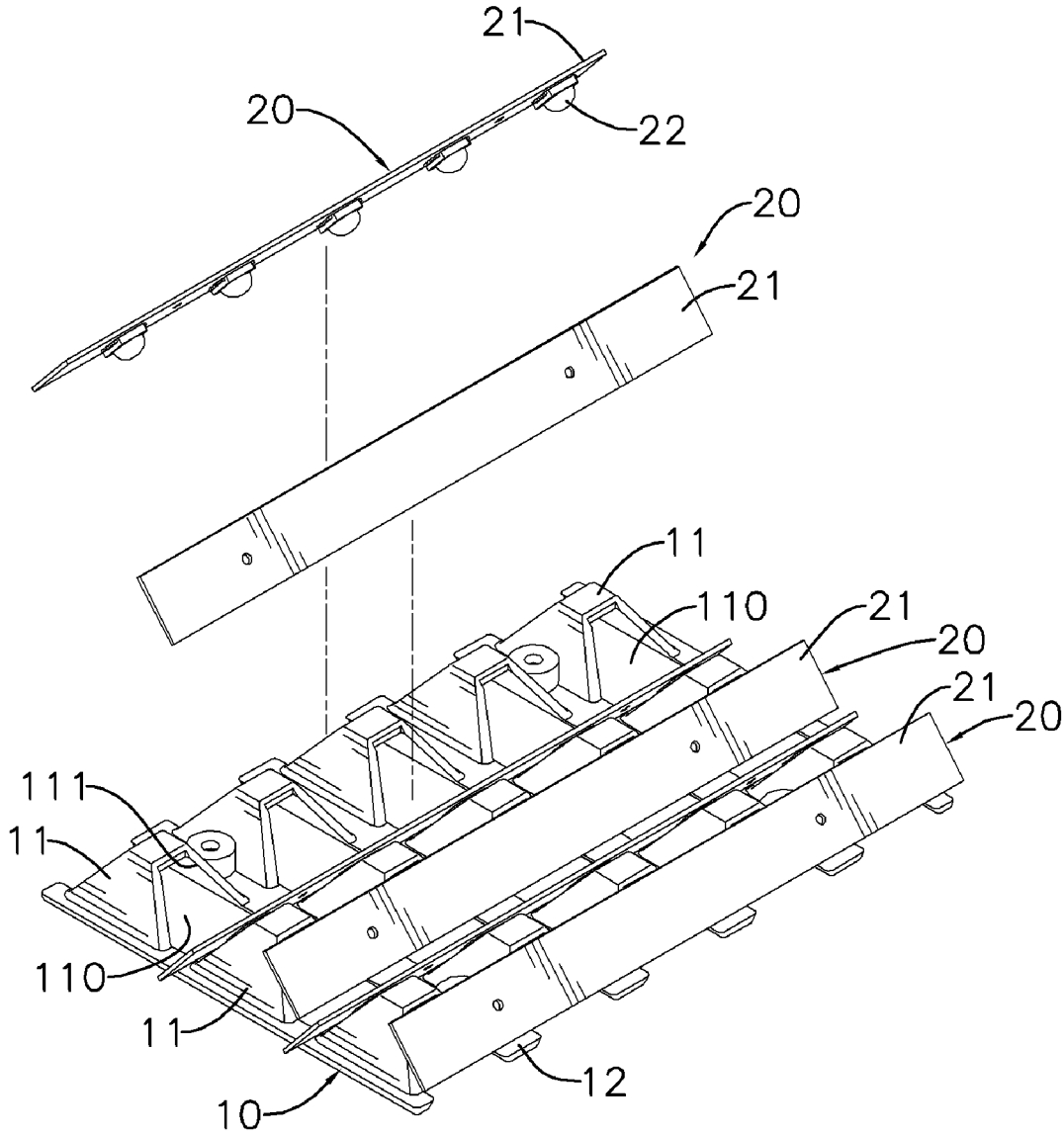
FIG. 1 is a perspective exploded view in partial of a first embodiment of an LED illuminator in accordance with the present invention.
Figure 2:
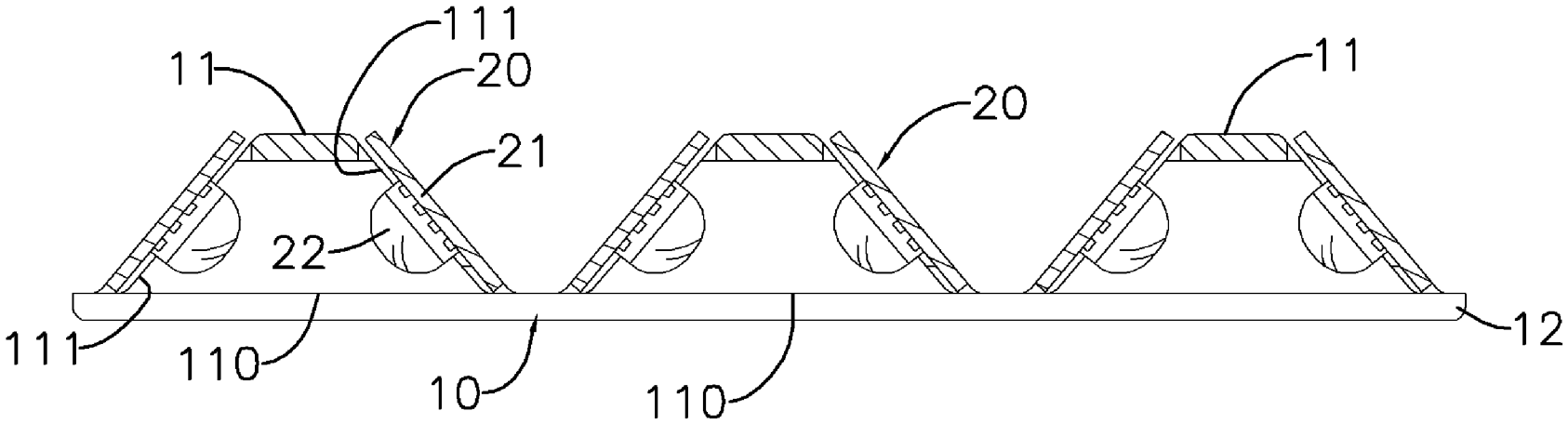
FIG. 2 is a cross sectional view in partial of the first embodiment of the LED illuminator in accordance with the present invention.

With reference to FIGS. 1 and 2, a first embodiment of an illuminator in accordance with the present invention has a seat (10) and multiple LED modules (20).

The seat (10) has a flat board (12) and multiple chambers (11) defined on the flat board (12) in matrix. Each chamber (11) is a shape of pyramid having four inclined sidewalls, a flat top, a bottom, two through holes (111) and an opening (110). The two through holes (111) are respectively defined on the two opposite sidewalls and the opening (110) is defined the bottom, so the through holes (111) and the opening (110) are communicated with each other.

The LED modules (20) are respectively mounted on corresponding row of the multiple chambers (11) on the flat board (12) to stand on flat board (12) at an inclined angle. Each LED module (20) has a circuit board (21) and multiple LED elements (22) mounted on the circuit board (21) in a line by same distance. The circuit board (21) is electronically connected to an external power source to drive the LED elements (22) thereon. An amount of the LED elements (22) of each circuit board (21) is equal to that of the corresponding row of the chambers (11). Therefore, each LED element (22) is aligned to one through hole (111) of the corresponding chamber (11) and lights of the LED element (22) radiate into the chamber (11) and then pass through the opening (110). Since each chamber (11) has the two opposite through holes (111), the lights of the two LED elements pass through the opening (110) of the chamber (11) to provide a wide illuminating angle.

Figure 6:
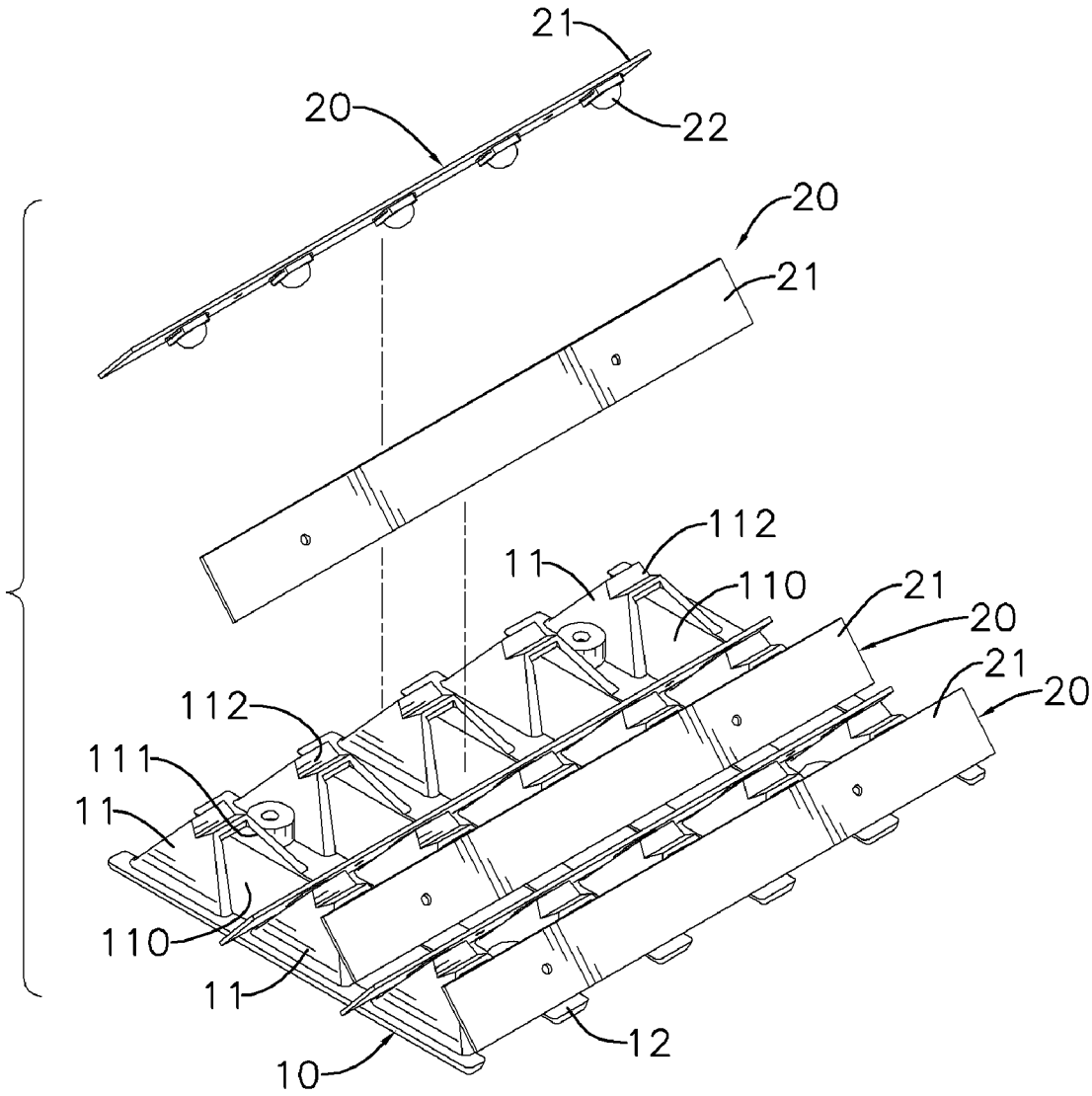
FIG. 6 is a perspective exploded view in partial of a second embodiment of an LED illuminator in accordance with the present invention.
Figure 7:
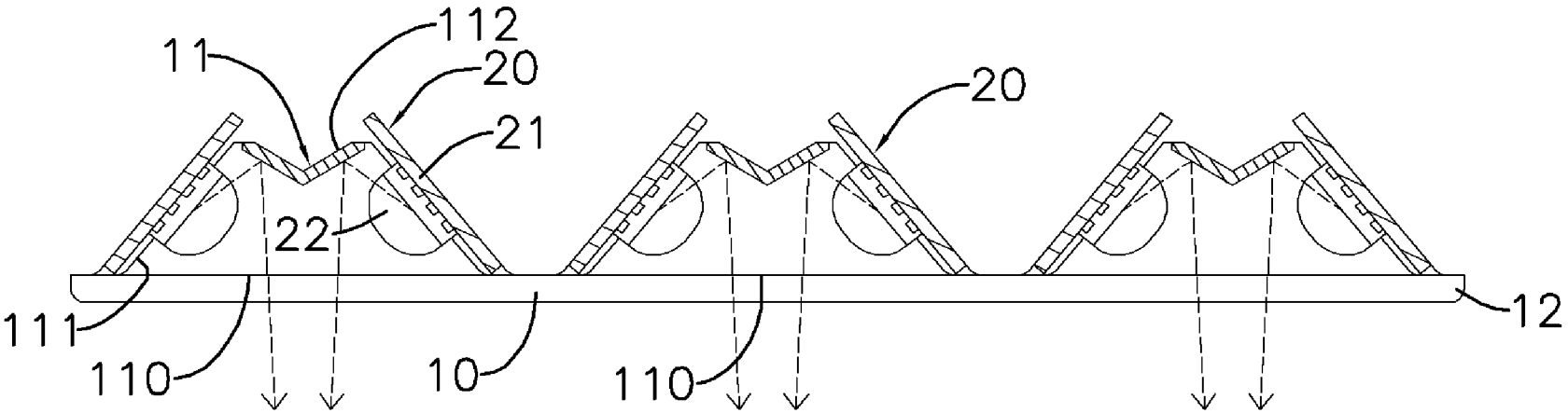
FIG. 7 is a cross sectional view in partial of the second embodiment of the LED illuminator in accordance with the present invention.

Further, since the two opposite sidewalls may be inclined at the inclined angle, the LED module (20) stands on the flat board (11) at the inclined angle when the LED module (20) is directly mounted on the corresponding sidewall. The LED element (22) is located inside the corresponding chamber (11) through the through hole (111). Therefore, the LED modules (20) stand on the flat board (12) at the inclined angle to allow the LED elements to face the opening (110) of the bottom of the corresponding chamber (11). A large part of the lights of each LED element directly pass through the opening (110) of the bottom. With further reference to FIGS. 6 and 7, each chamber (11) further has a V-shaped reflected protrusion (112) formed on tops of the two opposites sidewalls to reflect a small part of lights of the two LED elements (22) to the opening (110). The V-shaped reflected protrusion (112) has two inclined faces respectively faced to the two opposite through holes (111). Therefore, the small part of the lights of each LED element (22) radiated to the V-shaped reflected protrusion (112) is downwardly reflected to the opening (110). In addition, the other two opposite sidewalls of each chamber may be made of reflective material to reflect another small part of lights radiated from the two LED elements (22) to the opening (110).

Figure 3:
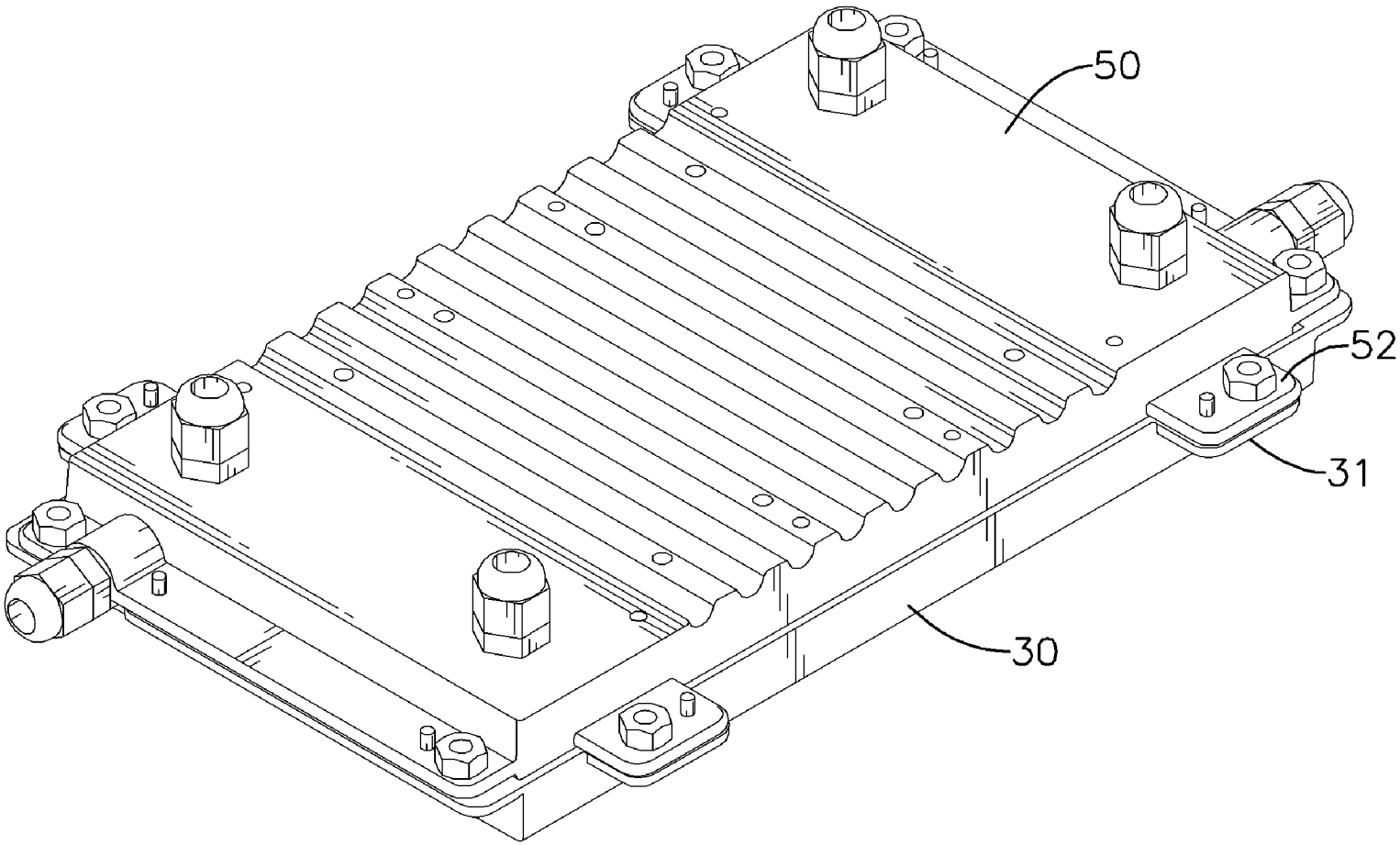
FIG. 3 is a perspective view of the first embodiment of the LED illuminator in accordance with the present invention.
Figure 4:
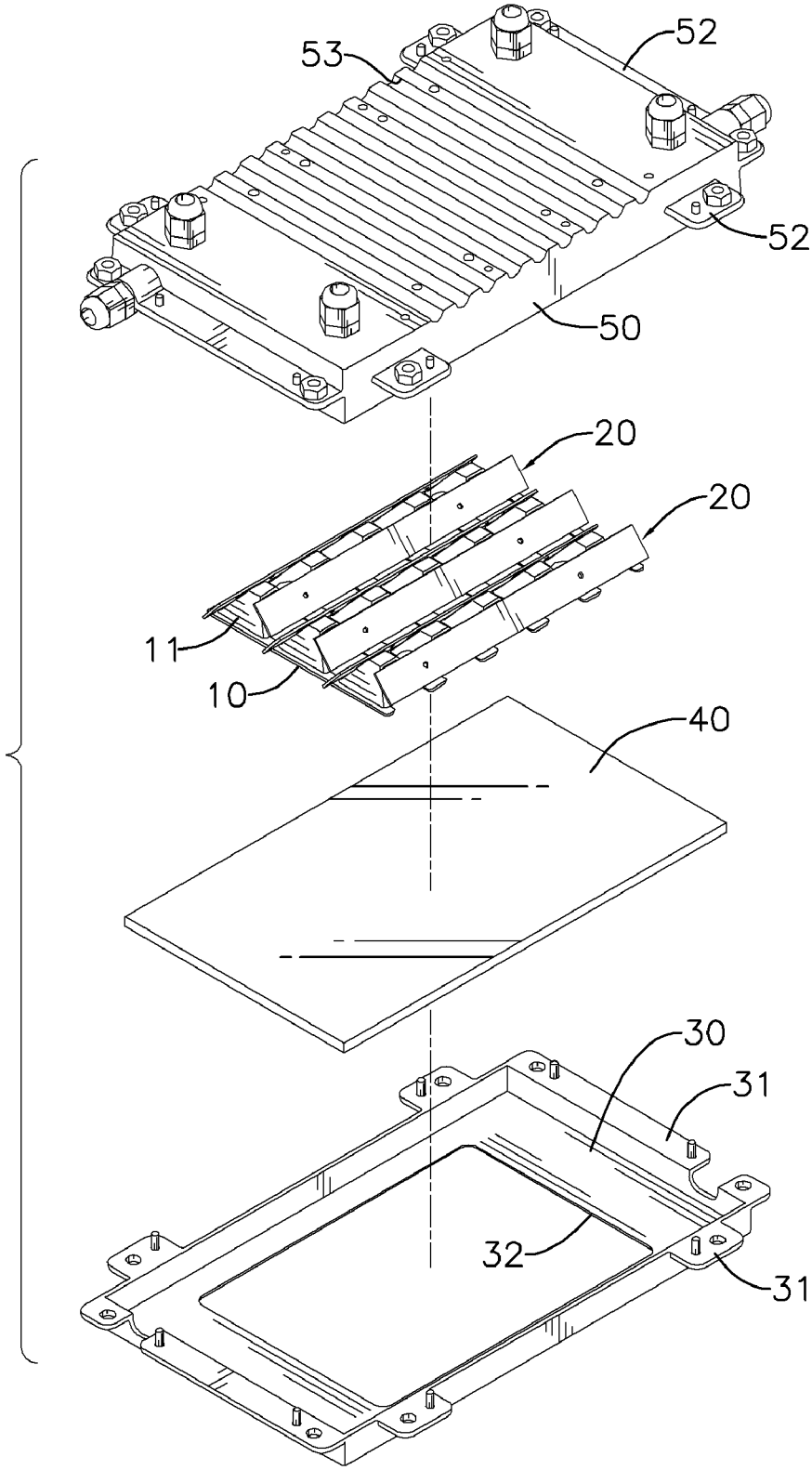
FIG. 4 is a perspective exploded view of the first embodiment of the LED illuminator in accordance with the present invention.
Figure 5:
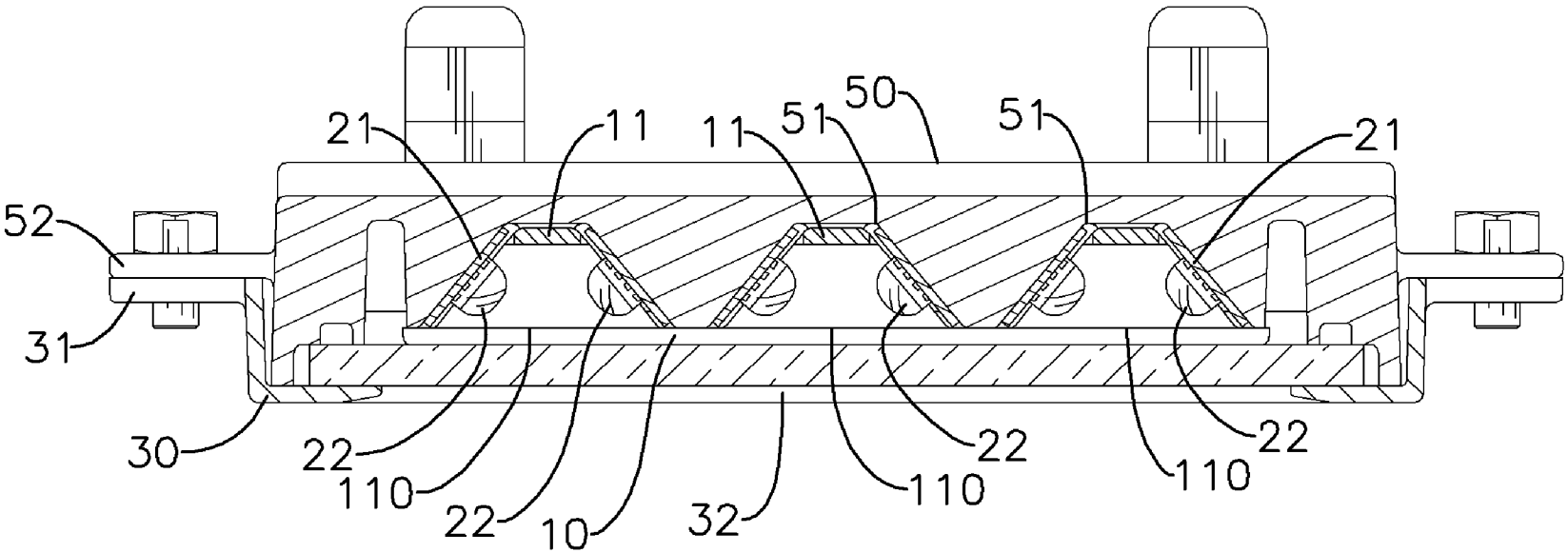
FIG. 5 is a cross sectional view of the first embodiment of the LED illuminator in accordance with the present invention.

With further referenced to FIGS. 3 to 5, the first embodiment of the LED illuminator further has a frame (30), a cover (40) and a heat conductive casing (50).

The frame (30) is rectangular, and has a bottom, four vertical sides, a bottom opening (32) and multiple positioning protrusions (31). The bottom opening (32) is defined through the bottom. A size of the bottom opening (32) matches that of the seat (10), so the openings (110) of the chambers (11) of the seat (10) are aligned to the bottom opening (32) of the frame (30).

The cover (40) is mounted inside the frame (30) and covers the bottom opening (32).

The heat conductive casing (50) is rectangular and has a top, a bottom, multiple positioning protrusions (52), a recess (51) defined in the bottom of the heat conductive casing (50) and multiple parallel slots (53) defined on the top. An outline of the recess (51) matches that of the seat (10), so that the seat (10) and the LED modules (20) are received inside the recess (51). The multiple positioning protrusions (52) are outwardly extended from four edges of the bottom of the heat conductive casing (50) and mounted to the corresponding positioning protrusions (31) of the frame (30). Therefore, the seat (10) and LED modules (20) are sandwiched in between the heat conductive casing (50) and the frame (30). Further, the cover (40) is located between the bottom of the seat (10) and the frame (30). Since multiple parallel slots (53) are defined on the top of the heat conductive casing (50) and top face area of the top is increased, a heat dissipating efficiency of the heat conductive casing (50) is increased. Therefore, the heat generated from the LED modules (20) is quickly dissipated by the heat conductive casing (50).

Based on the foregoing description, the illuminator using the LED modules as lighting source not only has a low power consumption and a long usage term, but also provides a wide illuminating angle and uniform illuminance.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An LED illuminator comprising:

a seat having a flat board; and multiple chambers defined on the flat board, wherein each chamber has two opposite sidewalls, a bottom, two through holes and an opening, wherein the two through holes are respectively defined on the sidewalls and the opening is defined through the bottom; and multiple LED modules respectively mounted on the sidewalls of the chambers on the seat and standing on the flat board of the seat at an inclined angle to allow light to pass through the openings of the chambers, and each LED module has a circuit board; and multiple LED elements mounted on the circuit board and each LED element is aligned to one through hole of the corresponding chamber and light of the LED element passes through the opening of the bottom of the corresponding chamber;

a rectangular frame having a bottom, four vertical sides, a bottom opening and multiple positioning protrusions, wherein the bottom opening is defined through the bottom and a size of the bottom opening matches that of the seat so that the openings of the chambers on the seat are aligned to the bottom opening of the frame;

a cover mounted inside the frame and covering the bottom opening; and a rectangular heat conductive casing being rectangular and having a top, a bottom, multiple positioning protrusions and a recess defined in the bottom, wherein the multiple positioning protrusions outwardly extend from four edges of the bottom and are mounted to the corresponding positioning protrusions of the frame and the seat and LED modules are sandwiched between the heat conductive casing and the frame.

2. The LED illuminator as claimed in claim 1, wherein each sidewall has a top and each chamber has a V-shaped reflecting protrusion formed on the tops of the two opposite sidewalls of each chamber to reflect part of the light emitted by the LED elements of each chamber to the opening.

3. The LED illuminator as claimed in claim 1, wherein the chamber is a pyramid shape.

4. The LED illuminator as claimed in claim 2, wherein the chamber is a pyramid shape.

5. The LED illuminator as claimed in claim 3, wherein the chambers are mounted on the seat in a matrix and each LED module is mounted on one row of the corresponding chambers.

6. The LED illuminator as claimed in claim 4, wherein the chambers are mounted on the seat in a matrix and each LED module is mounted on one row of the corresponding chambers.

7. The LED illuminator as claimed in claim 1, further comprising multiple parallel slots defined on the top of the rectangular heat conductive casing.

* * * * *